United States Patent [19]

Takahashi et al.

[11] Patent Number: 4,996,518

[45] Date of Patent: Feb. 26, 1991

[54] FIRE ALARM SYSTEM

[75] Inventors: Kaoru Takahashi; Akio Tsumiji; Ryuji Shutoku, all of Tokyo, Japan

[73] Assignee: Nohmi Bosai Co., Ltd., Tokyo, Japan

[21] Appl. No.: 468,866

[22] Filed: Jan. 23, 1990

[30] Foreign Application Priority Data

Jan. 31, 1989 [JP] Japan ..... 1-20985

[51] Int. Cl.[5] ..... G08B 26/00

[52] U.S. Cl. ..... 340/518; 340/505; 340/506; 340/517; 340/825.06; 340/825.08

[58] Field of Search ..... 340/518, 505, 506, 517, 340/825.06, 825.07, 825.08, 825.1–825.14, 825.54

[56] References Cited

U.S. PATENT DOCUMENTS

| | | | |
|---|---|---|---|
| 3,516,063 | 6/1970 | Arkin et al. | 340/825.1 |
| 3,559,177 | 1/1971 | Benson | 340/825.1 |
| 4,400,694 | 8/1983 | Wong et al. | 340/514 |
| 4,586,040 | 4/1986 | Akiba et al. | 340/825.08 |
| 4,847,593 | 7/1989 | Igarashi | 340/518 |

*Primary Examiner*—Donnie L. Crosland
*Attorney, Agent, or Firm*—Wenderoth, Lind & Ponack

[57] ABSTRACT

A fire alarm system includes a receiver unit connected to a plurality of terminal unit groupings, each of the terminal unit groupings made up of a plurality of terminal units. The fire alarm system operates in one of a system polling mode, a point polling mode and a selecting mode. In the system polling mode, the receiver units polls all of the terminal units and provides a grouping response period in which each of the terminal unit groupings is permitted to respond to the receiver unit polling. If one of the terminal units of a particular grouping undergoes a status change, such a terminal unit transmits to the receiver unit a group response signal during the corresponding group response period. Then, the system enters the point polling mode, in which the terminal units of the terminal unit grouping corresponding to the group response period in which a group response signal was received are polled. During a corresponding terminal unit response period, the terminal unit having the status change transmits a terminal unit response period to the receiver unit. Thereafter, the fire alarm system enters the selecting mode, in which status information is transmitted to the receiver from the terminal unit having the status change.

21 Claims, 15 Drawing Sheets

FIRE ALARM SYSTEM

DETAILED DESCRIPTION OF THE INVENTION

Background of the Invention

The present invention relates to a transmission procedure performed between terminals, such as fire detectors and/or repeaters, and receiver units, such as a control panel or repeaters, in a fire alarm system.

PRIOR ART AND ITS PROBLEMS

For transmission between terminals such as fire detectors and/or repeaters, and a receiver unit such as a control panel or a repeater in a fire alarm system, many of the conventional systems adopt a procedure consisting of calling the individual terminals successively from the receiver unit and collecting status information from each of the thus called terminals.

In such a prior art system, the polling time extending from the call of the predetermined terminal till receipt of data indicating the status of the terminal by the receiver unit is fixed, and shortening of the polling time is limited.

It is necessary for fire alarm systems to quickly transmit predetermined information from terminals, such as fire detectors and/or repeaters, to a receiver unit such as control panel or repeater, and accordingly there it is requested that time required for the receiver unit to determine the status of all terminals connected thereto to be shortened to a minimum.

Nevertheless, since there is a limit to the shortening of the polling time in the conventional systems, it is difficult to further shorten the time needed for the receiver unit to securely determine the status of all terminals in which an abnormality has occurred among those connected to the receiver unit.

SUMMARY OF THE INVENTION

The present invention aims at offering a fire alarm system which is capable of further shortening the time needed for the receiver unit to accurately determine the status of all terminals in which an abnormality has occurred among those terminals connected to a receiver unit.

For this purpose, the fire alarm system according to the present invention includes plural terminals, such as fire detectors and supervisory repeaters connected with the fire detectors, or control repeaters connected with apparatus being controlled such as local bells and/or the like, which are divided into plural groups. Normally the terminals are supervised by performing system polling on each terminal group individually. If there is a group which has responded to the receiver unit at the time of system polling, the terminals in the group are called by point polling to see which of the terminals responds If there is a terminal which responded at the time of point polling, the terminal is called during a selecting mode to collect status information from the terminal.

Further, the present invention aims at quickly controlling a terminal(s) associated with the terminal which has detected an abnormality, and a specific terminal(s) in the above fire alarm system.

Further, the present invention aims at making provisions which enable a common command to be transmitted simultaneously to plural terminals in the above fire alarm system.

Further, the present invention aims at periodically supervising the signal lines in the above fire alarm system for line interruption.

Still further, the present invention aims at increasing the reliability of signal transmission by polling in the above fire alarm system.

DETAILED DESCRIPTION OF THE EMBODIMENT

Figure 1:
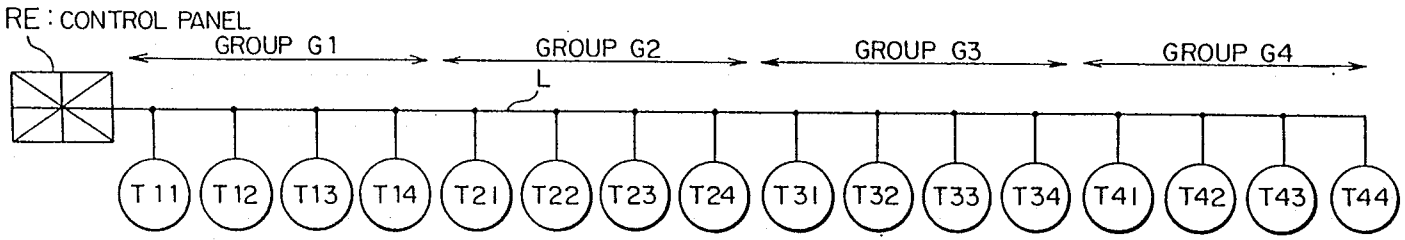
FIG. 1 is a drawing which shows an example of terminals divided into groups in an embodiment according to the present invention.

FIG. 1 shows an example of a plurality of terminals divided into groups according to an embodiment of the present invention. In this example, terminals T11–T44 are divided into four groups G1, G2, G3 and G4 and connected to a control panel RE the control panel being an example of a receiver unit Although four terminals are shown per group in the embodiment, the number of the terminals is not necessarily be limited to four, and each group may intend include any other number of terminals. The terminals may also be divided into a number of groups other than four Each of the terminals T11–T44 is a fire detector (analog type or ordinary type) or a repeater. To the repeater, supervisory apparatus (fire detector and the like) or apparatus to be controlled (local bell, fire door, smoke damper and the like) are connected.

The control panel RE performs polling of the terminals T11–T44 in a system polling mode, a point polling mode and a selecting mode, and collects predetermined information from a predetermined terminal(s) and controls the predetermined terminal(s).

In the systems polling mode polling which is performed on each of the four terminal groups of the terminals T11–T44, rather than individually on each of the terminals. A return timing is provided for each group being polled so that a group having a status terminal(s) showing a change can respond to the control panel RE at the return timing In the point polling mode polling is performed on each of the terminals in a group which has responded to the control panel RE during the system polling mode. A return timing is provided for each terminal so that a terminal(s) having a status change can respond to the control panel RE at the return timing.

In the selecting mode predetermined information is collected from a terminal which has responded to the control panel RE during the point polling mode and a predetermined control command is to transmitted this terminal or to another terminal(s).

During system polling the control panel RE transmits a common command(s) to the plural terminals simultaneously. The common commands include, for example, a fire resetting command (a command for resetting the terminal(s) which initiated a fire signal, such as detector and repeater, and/or a terminals which caused the local bell to sound, to their normal supervisory state), a resetting command for delayed action (a command for resetting the terminal(s) which initiated a fire signal, such as fire detector or repeater, to perform a delayed action for discriminating whether the fire condition is continuing for a predetermined period of time), and a local alarm silencing command (a command for silencing the local bell).

Furthermore, the control panel successively calls the plural terminals with a request for specific information. When the specific information is received from a terminal, the control panel judges that there is no line interruption between the control panel and a terminal The control panel also uses information to identify the type of the terminal (hereinafter called type information) received from the terminals as the specific information mentioned above and compares the thus received "type information type" with the information previously stored in the control panel. If the received and stored "type" information should not match, the control panel judges that the terminal has been exchanged with a different type of terminal.

Figure 2:
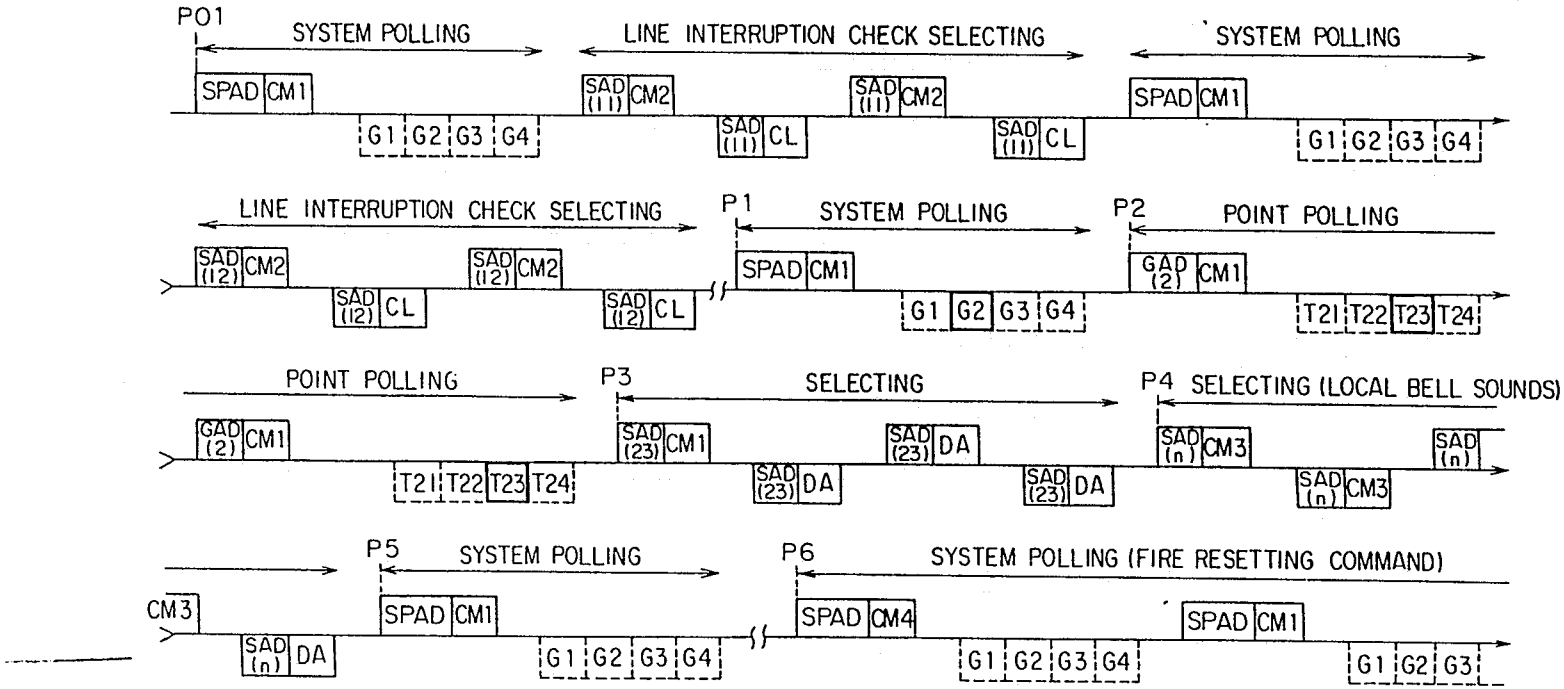
FIG. 2 is a drawing which shows an example of the operation of the above embodiment.

FIG. 2 shows an example of the operation of the above embodiment, proceeding from the upper left toward the upper right, then from the right end toward the left on the line immediately below and so on. FIG. 2 shows the operations of the control panel R1 and the terminal (or group) above and below the horizontal lines respectively.

Also in FIG. 2 the frames drawn with broken lines indicate that there was no response at the return timing while the frames drawn with solid lines indicates that there was a response at the return timing. In other words, a solid line frame denotes a terminal having a change in its status (or a group which has a terminal having a change in its status) as compared with the status at the time immediately before the return timing Firstly, system polling is performed at Pl in FIG. 2. After transmitting the address SPAD denoting the system polling and the status information return command CM1 to the groups G1–G4, the control panel RE successively provides the groups G1–G4 a timing period for their returning status information. Each of the groups G1–G4 responds to the control panel RE by returning status information at its return timing only if their is a change in status of any one of the terminals in the group. In the case of the example shown in FIG. 2, the terminal T23 has a change in its status, and accordingly the group G2 alone responds to the control panel RE. Thus, the control panel RE determines that one of the terminals T21–T24 in the group G2 has a change in its status and possesses status information to be transmitted to the control panel RE.

Next, point polling is performed at P2. The control panel RE transmits the address GAD of the group to be polled and the status information return command CM1 to the terminals in the group. In the case of the above example, the control panel RE transmits the address GAD (2) and the status information return command CM1 to the terminals T21–T24, successively providing these terminals with a timing period for their returning status information. Each of the terminals responds to the control panel RE by returning status information at its own return timing only if there is a change in its status. Since the terminal T23 has a change in its status at the above point polling, this particular terminal T23 alone responds to the control panel RE. Thus the control panel RE determines that the terminal T23 has a change in its status and possesses status information to be transmitted to the control panel RE.

Then, the selecting mode is performed at P3. The control panel RE transmits the status information return command CM1 and the address SAD of the terminal from which the response signal has been received Since the response signal has been received from the terminal T23 in the case of the above example, the control panel RE transmits the address SAD (23) of the terminal and the status information return command CM1. In response, the terminal T23 transmits its self-address SAD (23) and the data DA which the terminal is to transmit (for example a fire signal) to the control panel RE.

Upon receipt of the data DA, the control panel RE returns the self-address SAD (23) and the received data DA to the terminal T23. Then, the terminal T23 compares the returned data DA with the data DA which was transmitted immediately before. If the both data match, the terminal T23 again transmits the above data DA to the control panel RE. When the first and the second data DA received by the control panel RE match, having control panel RE recognizes the data DA as the been transmitted from the terminal T23 and performs necessary processing on the basis of the received data DA.

In the event that a 'fire' decision has been made as a result of discrimination of the data DA which the control panel RE received during the above selecting mode, the 'n'-th apparatus to be controlled is operated (for example, the local bell is sounded.) at P4. In the above example the control panel RE transmits the address SAD(n) of the terminal Tn and the sounding command CM3.

As the terminal Tn is called by the control panel RE and receives the local bell sounding command CM3, the terminal Tn returns its self-address(n) and the sounding command CM3 received to the control panel RE for confirmation. As the terminal Tn is called by the control panel RE and receives the same sounding command CM3 from the control panel RE again, the terminal Tn controls the local bell to sound for the first time and returns the data DA on the control status thereof and the self-address SAD(n) to the control panel RE.

After this, a operation returns to the normal condition and the above system polling is repeated Now, processing of the common command is described hereinafter. As the operator inputs the fire resetting commands which is one of the common commands, in the control panel RE at P6 in FIG. 2, the control panel RE transmits the address SPAD showing the system polling and the fire resetting command CM4

Accordingly the supervisory terminal resets to the supervisory state, and the control terminal discontinues the control (for example, the local bell stops sounding), and the fire alarm system returns to the normal supervisory state.

While in the above example the common command, such as the fire resetting command, is transmitted only once, its transmission may be repeated plural times (e.g. five times) so that the common command may be executed as a right one when the same common command has been received more than a predetermined number of times (for example, more than three times), thus preventing false operation due to transmission error.

In the above example, the point polling mode and the selecting mode are performed twice respectively for the purpose of preventing false transmission due to induction noise.

The operation for checking for an open in the main transmission line L is described hereinafter.

At P01 in FIG. 2, the system polling is performed once. The selecting mode is performed to check for an open in the main transmission line L extending up to the terminal T11. That is, the control panel RE transmits the address SAD (11) of the terminal T11 and the specific information return command CM2, and the terminal T11 returns the self-address SAD (11) and the specific information (in this case the 'type', information CL indicating the type of the terminal) to control panel RE. Upon receipt of the type information CL from the terminal T11, the control panel RE judges that there is no open in the main transmission line L extending from the control panel RE to the terminal T11.

Then, the system polling is performed once again to confirm that no terminal has changed status, and after this the line interruption check is performed with respect to the terminal T12 in the same manner as described above. In this way, the line interruption check is performed with respect to the transmission line from the control panel RE to each terminal, and a system polling operation is performed intermediately the line interruption checks. If any of the groups respond during system polling, the point polling and the necessary selecting operators are performed with respect to the particular group.

The "type" information CL includes the data denoting a supervisory repeater, control repeater, supervisory & control repeater, analog type fire detector and the like. By having the control panel collect the "type" information as the above specific information, it is possible to determine whether or not a terminal(s) has been connected, and at the same time whether or not any change has been made regarding the types of connected terminals. Since the for line interruption check is performed each time system polling is performed in the above example, it is necessary to repeat the system polling sixteen times for supervision of all the terminals T11–T44

However, the line interruption check may be performed each time the system polling has been performed a predetermined number of times or at predetermined time intervals, and further, the line interruption check selecting mode operations may be performed on plural terminals at a time It is possible to prevent misjudgement due to induction noise by successively performing the selecting for line interruption check on the same terminal twice. The specific information may include data other than the "type" information such as, for example, specific codes.

Figure 3:
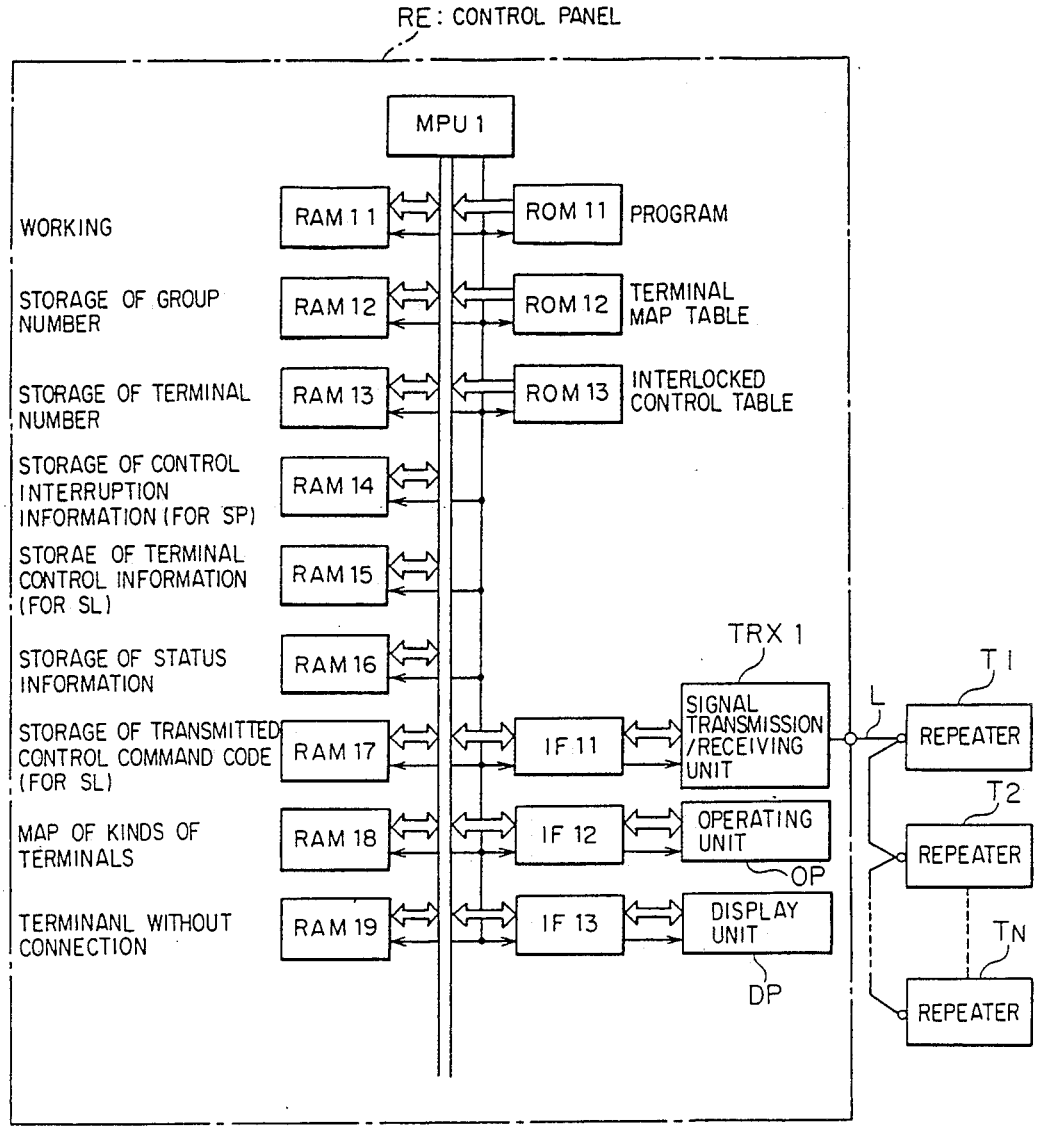
FIG. 3 is a block diagram which shows an example of the control panel RE which operates as a receiver unit in the above embodiment, and an example of the connection between the control panel RE and the repeater.

FIG. 3 is a block diagram showing an example of the control panel RE in the above embodiment and the connection between the control panel RE and the repeaters.

The control panel RE is equipped with a microprocessor MPU1, RAM11–RAM19, ROM11–ROM13, IF11–IF13, a signal transmission/receiving unit TRX1, an operating unit OP and a display unit DP.

The ROM11 is an area where programs related to the flowcharts shown in FIGS. 5–10 are stored. The ROM 12 is a storage area for terminal map tables such as the number n of repeaters T1–Tn, the group g to which the repeaters belong, the number m within the group and kinds The ROM 13 is a storage area for an interlocked control table.

The RAM11 is a working area. The RAM12 is a storage area for the group number g which has transmitted a response signal at the time of system polling. The RAM13 is a storage area for the terminal number n which has transmitted a response signal at the time of point polling. The RAM13 may be made to store the group number g and the terminal number m within the group, instead of the terminal number n of the terminal which transmitted the response signal, and to then determine the terminal number n on the basis of the group number g and the terminal number m.

The RAM14 is a storage area where the controls effected at the time of system polling are stored. The RAM15 is an area where the terminal numbers to be controlled and controls effected during selecting mode operations are stored. The RAM16 is a storage area for status information collected from the terminals T1–Tn. The RAM17 is a storage area for the control command codes which have been transmitted The RAM18 is a storage area for information the regarding types of connected terminals. The numbers and types of the terminals stored in the ROM 12 are loaded at the time of initial setting, but are changed thereafter according to the "type" information collected through the line interruption check. The RAM19 is a storage area for the terminals connected with a line(s) which has been judged as being in an interrupted state as a result of the line supervision for an open.

The signal transmission/receiving unit TRX1 comprises a parallel/series converter, a signal transmission circuit and a series/parallel converter. The operating unit OP is equipped with various switches and ten keys. The display unit DP is equipped with various indicator lamps and a CRT.

Figure 4:
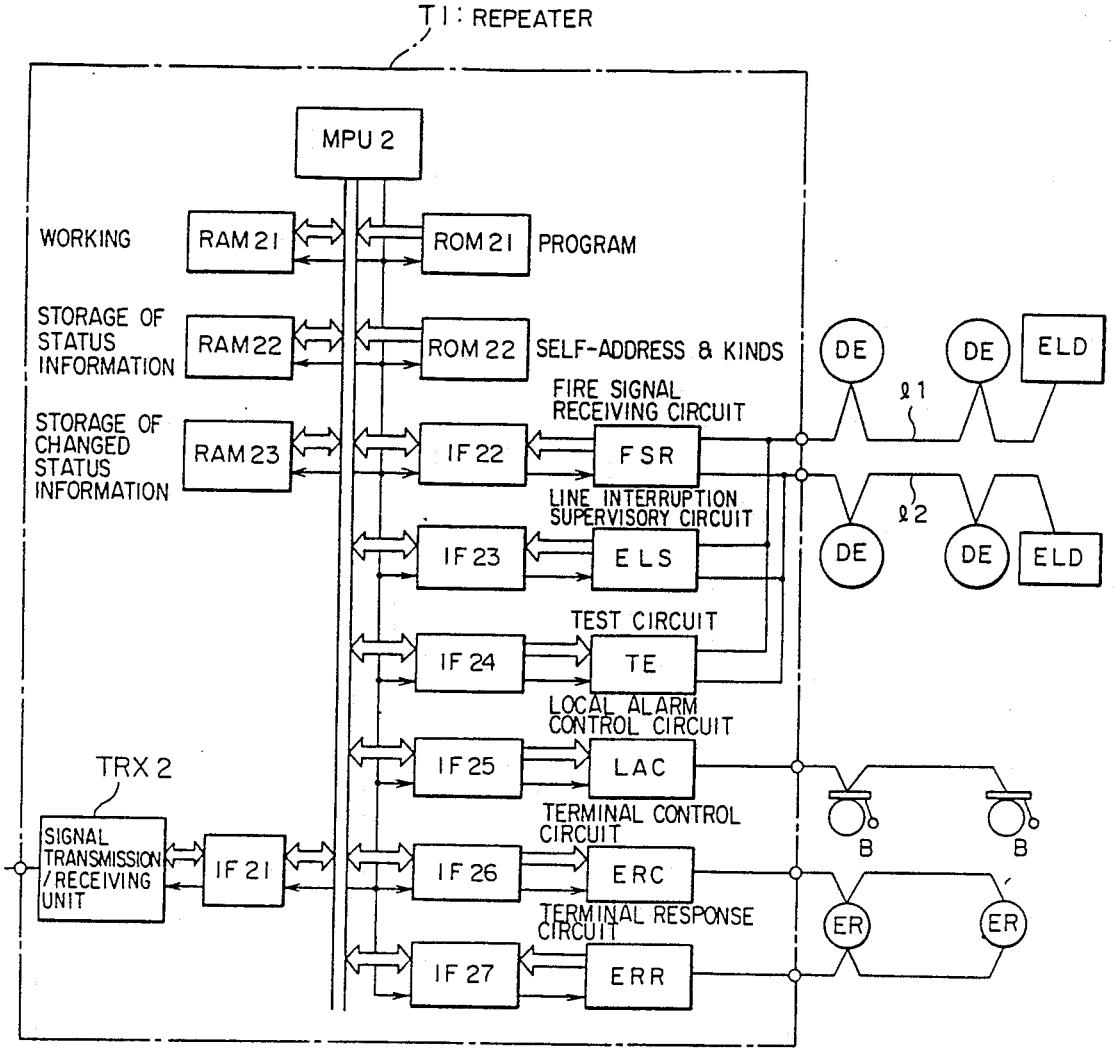
FIG. 4 is a block diagram which shows a specific example of the repeater T1 which operates as a terminal in the above embodiment, and an example of the detectors or the like connected to the repeater T1.

FIG. 4 is a block diagram showing a specific example of the repeater T1 in the above embodiment and examples of detectors and the like connected to the repeater T1.

The repeaters T2–Tn have the same composition as the repeater T1.

The repeater T1 is equipped with a microprocessor MPU2 RAM2–RAM23, ROM21, ROM22, IF21–IF27, a signal transmission/receiving unit TRX2, a fire signal receiving circuit FSR, a line interruption supervisory circuit ELS, a test circuit TE, a local alarm control circuit LAC, a terminal control circuit ERC and a terminal response circuit ERR.

The ROM21 is a storage area for programs related to the flowcharts shown in FIGS. 11–14 The ROM22 is a storage area for the group addresses to which the terminals belong, the self-addresses and type information of the terminals. A dip switch may be used in lieu of the ROM22.

The RAM21 is a working area. The RAM22 is a storage area for status information. The RAM23 is a storage area for the changed status information. The signal transmission/receiving unit TRX2 is the same as the signal transmission/receiving unit TRX1. The fire signal receiving circuit FSR comprises a zone relay or a comparator which detects the fire signal from a fire detector DE. In the case of the above embodiment a self-holding circuit is to be provided.

The line interruption supervisory circuit ELS is a circuit for detecting an open in the zone lines λ1, λ2 and for initiating the line interruption signal upon detection of the open. The test circuit TE transmits the fire signal to a fire signal receiving circuit FSR when conducting the test. The local alarm control circuit LAC is a circuit which controls the sounding of the local bell B. The terminal control circuit ERC is a circuit which controls the devices ER, such as a fire door, smoke vent damper, smoke damper and fire extinguishing system. The terminal response circuit ERR is a circuit which receives response signals from the controlled devices The main transmission lines L (shown in FIG. 3) are, for example, a pair of power supply/signal lines extending from the control panel RE to the repeaters T1-Tn as terminals. The zone line λ1, λ2 are a pair of power supply/signal lines. The fire detectors DE are connected to the zone lines λ1, λ2 which are run from detector to detector without interruption. The fire detector is of ordinary ON-OFF type which initiates a fire signal on detection of a fire phenomenon exceeding a predetermined level. The end of line device ELD is an end of line resistor provided at the end of the zone lines λ1, λ2.

While in FIG. 4 the repeater T1 is specified as being a combined type which is used both for supervision of abnormality detectors, such as a fire detector, and for control of local alarm devices and various controlled devices, separate types of repeaters, i.e. one for supervision and the other for control, may be provided. In the case where a gas sensor is connected as an abnormality detector, for example, a gas leak signal receiving circuit is provided in lieu of the fire signal receiving circuit FSR. In the case where the terminal itself is an abnormality detector, e.g. an analog type fire detector, a fire phenomenon detecting means having a fire phenomenon detecting unit, an amplifier circuit, a sample hold circuit and an AD converter is connected to the IF22, and the line interruption detecting circuit ELS, local alarm control circuit LAC, terminal control circuit ERC and terminal response circuit ERR are omitted Operation of the above embodiment is described hereinafter.

Figure 5:
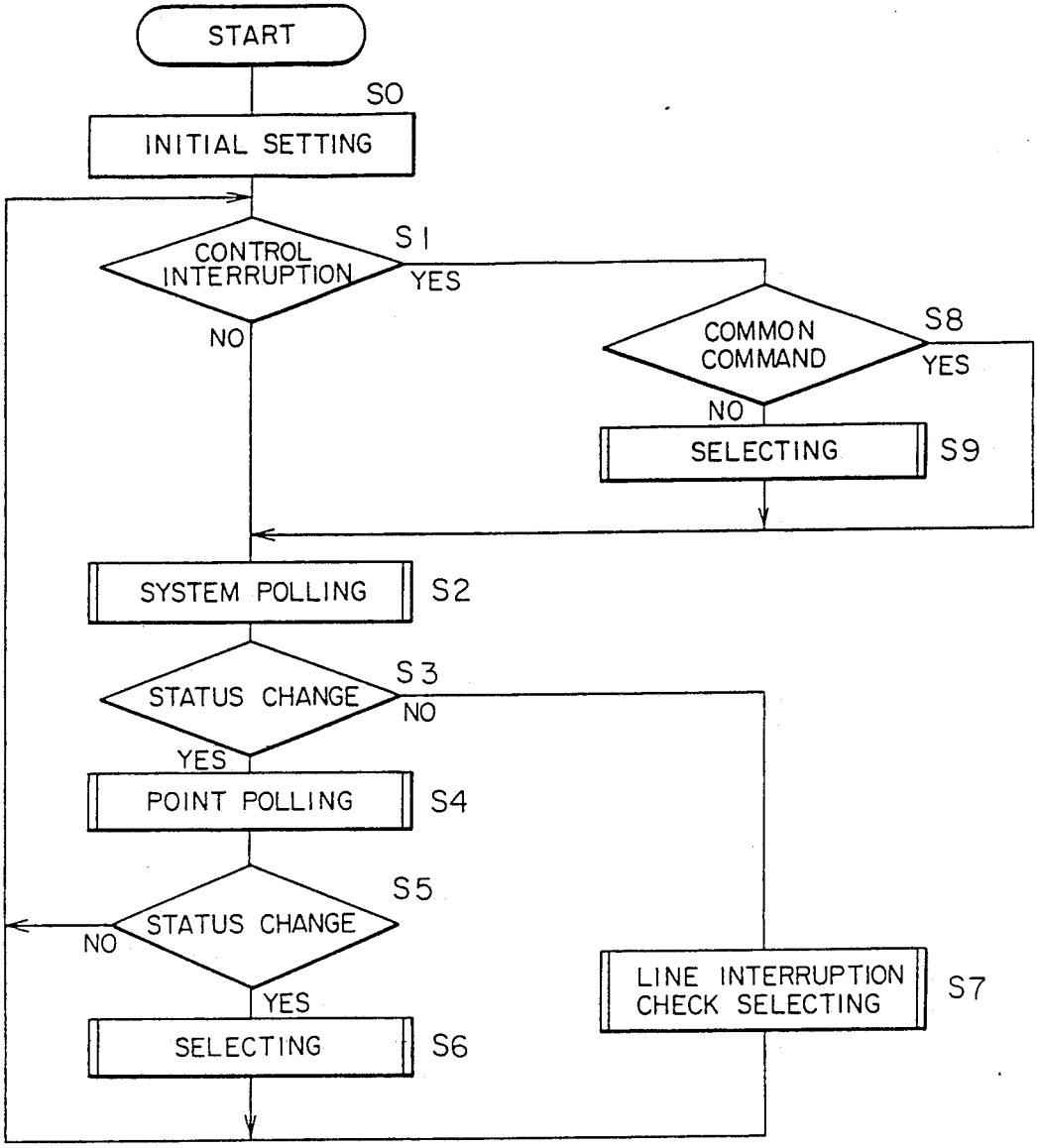
FIG. 5 is a system flowchart of the control panel RE in the above embodiment.

FIG. 5 is a system flowchart of the control panel RE in the above embodiment.

Firstly, the initial setting is carried out (S0) to determine whether or not there is a control interruption (S1). This control interruption is an interruption which occurs in response to an input from the operating unit OP or is caused by selecting during the supervision. If there is no control interruption, the system polling is performed (S2). If a status change is found during system polling (namely, if there is a group which transmitted a response signal)(S3), the point polling is performed (S4). If a status change is found during point polling (namely, if there is a terminal which transmitted a response signal) (S5), the selecting operation is performed (S6).

If no status change is detected during system polling the line interruption check selecting mode operation is performed (that is, the operation to check and see whether the terminals T11–T44 are properly connected to the control panel RE without interruption)(S7). This line interruption check is performed on each of the terminals T11–T44 in the event that there is no group responds when the system polling is performed.

If there is a control interruption at S1, but no common command (that is commands such as a fire resetting command, resetting command for delayed action and local alarm silencing command which are common to the plural terminals and discriminated by memories in the RAM14) (S8), the selecting operation is performed (S9) to effect individual controls according to the memories in the RAM15. If there is a common command at S8, the system polling is performed (S2) to effect control according to a common command stored in the RAM14.

Figure 6:
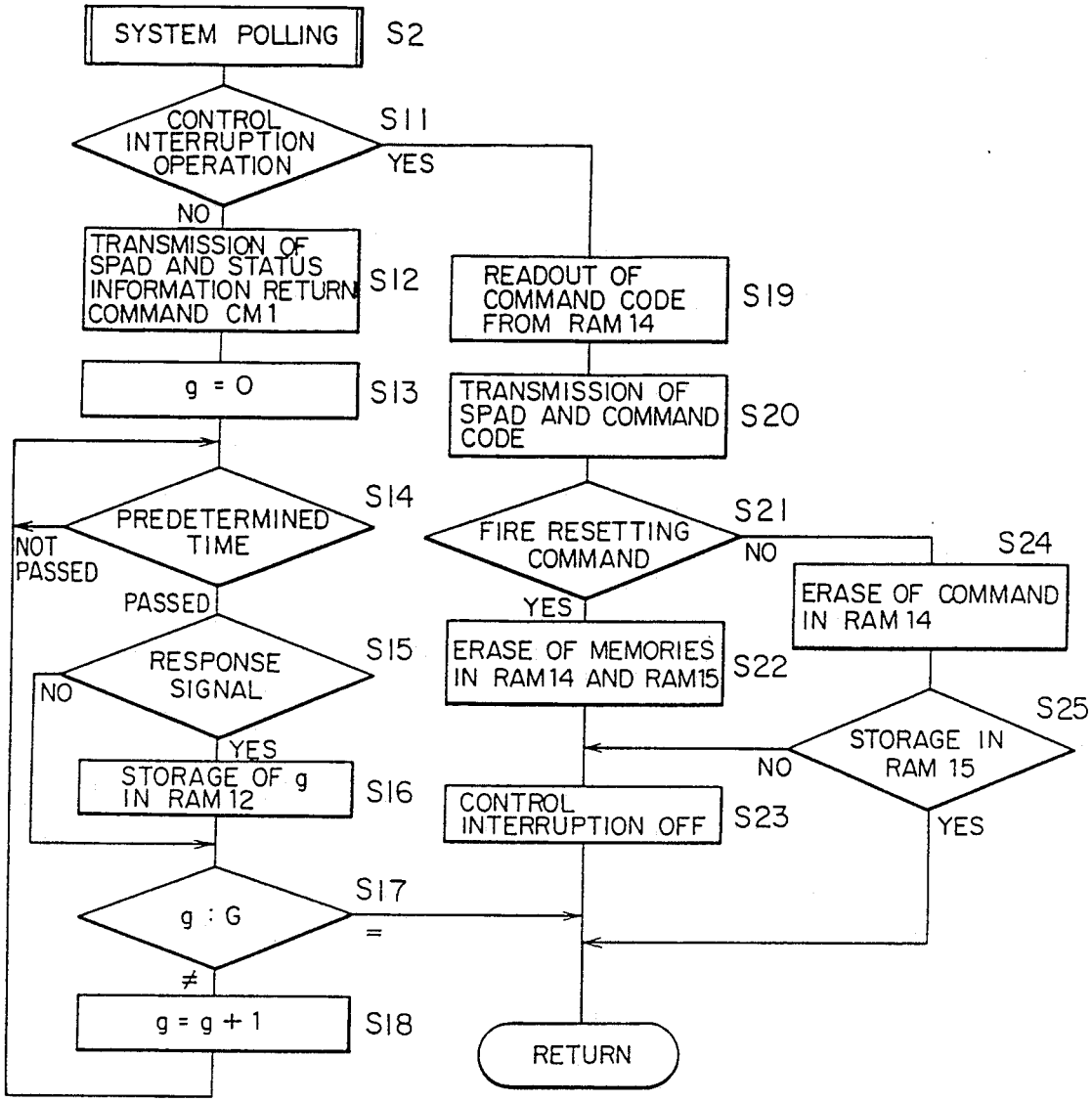
FIG. 6 is a flowchart showing an example of the system polling (S2) shown in FIG. 5.

FIG. 6 is a flowchart which shows the system polling (S2) shown in FIG. 5.

Firstly the control panel RE transmits the address SPAD which denotes system polling and the status information return command CM1 (S12) and sets the terminal group number g to [0](S13) since normally control interruption operation by common command is not required (S11). And, if there is a response signal (S15) when the predetermined time corresponding to the return timing of the group G1 has passed (S14), the group number g which initiated the response signal is stored in the RAM12 (S16). Then, the terminal group number is incremented by one (S18), and the above operations S14–S16 and S18 are repeated until the terminal group number g reaches the last terminal group number g (S17), and the operation returns to the main program.

On the other hand, if there is an input command (control interruption command) from the operating unit OP, the command code is read out (S19) from the RAM14 where the control interruption information is stored, and the SPAD and the command code are transmitted (S20). If the command code transmitted is the fire resetting command (S21), the memories in the RAM14 and the RAM15 are not needed and therefore erased (S22), the control interruption flag is reset to off (S23) and the operation returns to the main program. In the event that the command code is not the fire resetting command, the corresponding command in the RAM14 is erased (S24) to prevent it from being retransmitted, and the control interruption is off and the operation returns to the main program if no information for terminal control has been stored in the RAM15. If there is a memory in the RAM15 (S25), the control interruption is not off and the operation returns to the main program.

Figure 7:
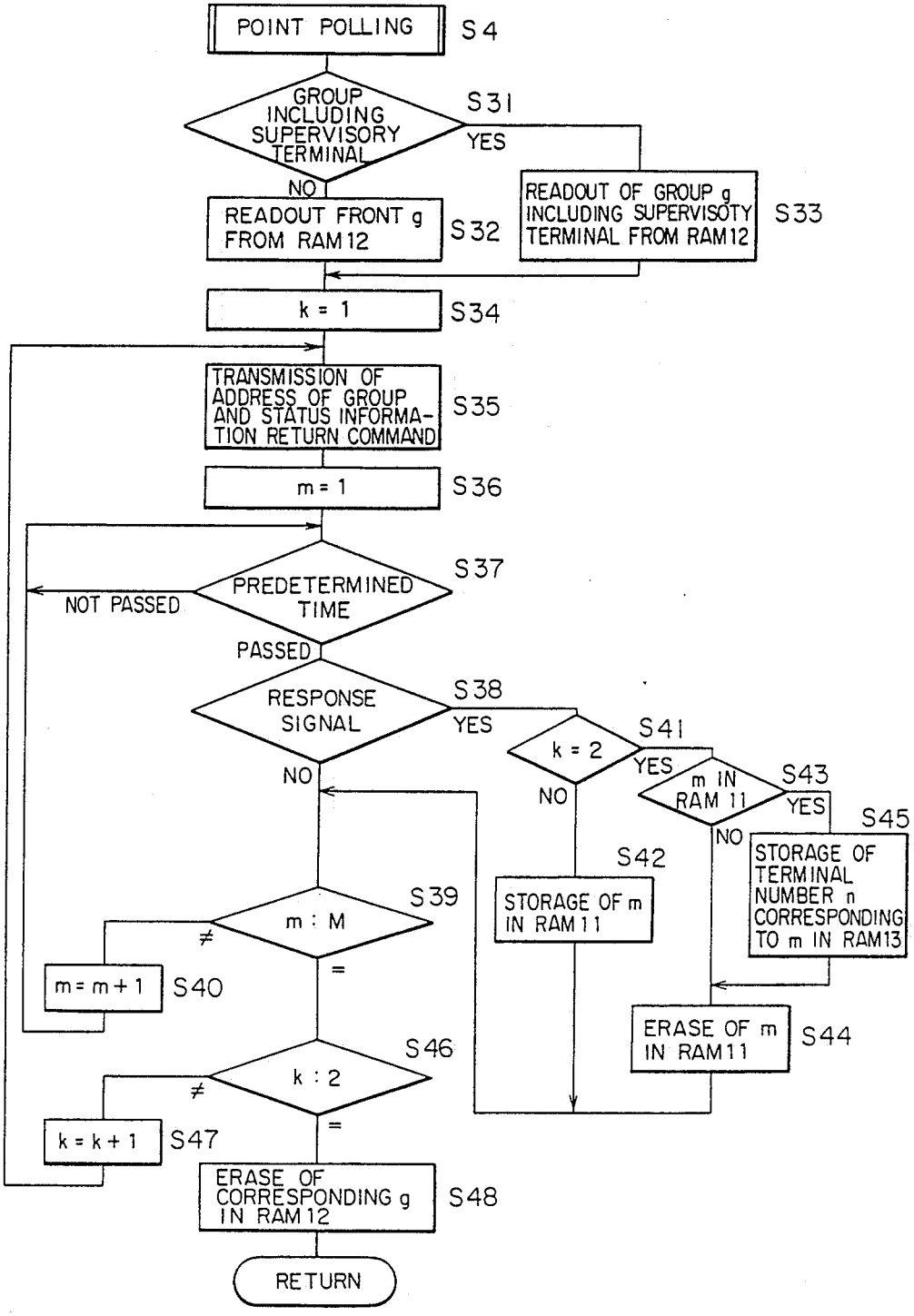
FIG. 7 is a flowchart showing an example of the of point polling (S4) shown in FIG. 5.

FIG. 7 is a flowchart which shows the operation of the point polling (S4) shown in FIG. 5.

Firstly, a determination is made as to whether there is a group(s) which includes a supervisory terminal(s)

such as repeater connected with fire detectors in the groups in which the terminal having the status change stored in the RAM12 are included. If there exists a group which includes the supervisory terminal (S31), the group number g is read out from the RAM12 (S33), and the frequency k of the point polling is set to [1](S34). Then, the address of the group and the status information return command CM1 are transmitted, and the terminal number m of the group is set to [1](S35, S36). When the response signal has been received from the terminal m within the predetermined time (S37, S38), judgment a is made as to whether the response has been received during the first polling or the second polling (S41).

If the response is received during the first polling, the receipt of the response signal from the terminal number m is stored in the RAM11 (S42), and the above operation is repeated up to the last number of the terminals in the group (S39, S40). Then, the frequency k of the point polling is changed to [2](S46, S47), and the address of the group and the status information return command CM1 are transmitted again (S35). If the response is received during second point polling (S41), a judgment S43 is made as to whether the response signal has been received from the terminal m in both the first and the second polling (S43). If so, the terminal number n corresponding to the terminal number m is stored in the RAM13 (S45) and the latter number m in the RAM11 is erased (s44). When the above operations have been repeated up to the last terminal in the group, the group number g in the RAM12 is erased (S48), and the operation returns to the main program. If there is no group which includes a supervisory terminal at step S31, the first group number g to be point polled is read out from the RAM12 (S32).

Although as described above that the point polling is to be performed twice, the frequency of the point polling may instead be one or three or more. If there is no need of giving priority to point polling on the group in which the supervisory terminal is included, the point polling may be performed on the groups in the order as stored in the RAM12. In this case, S31 and S33 in FIG. 7 are omitted.

Figure 8:
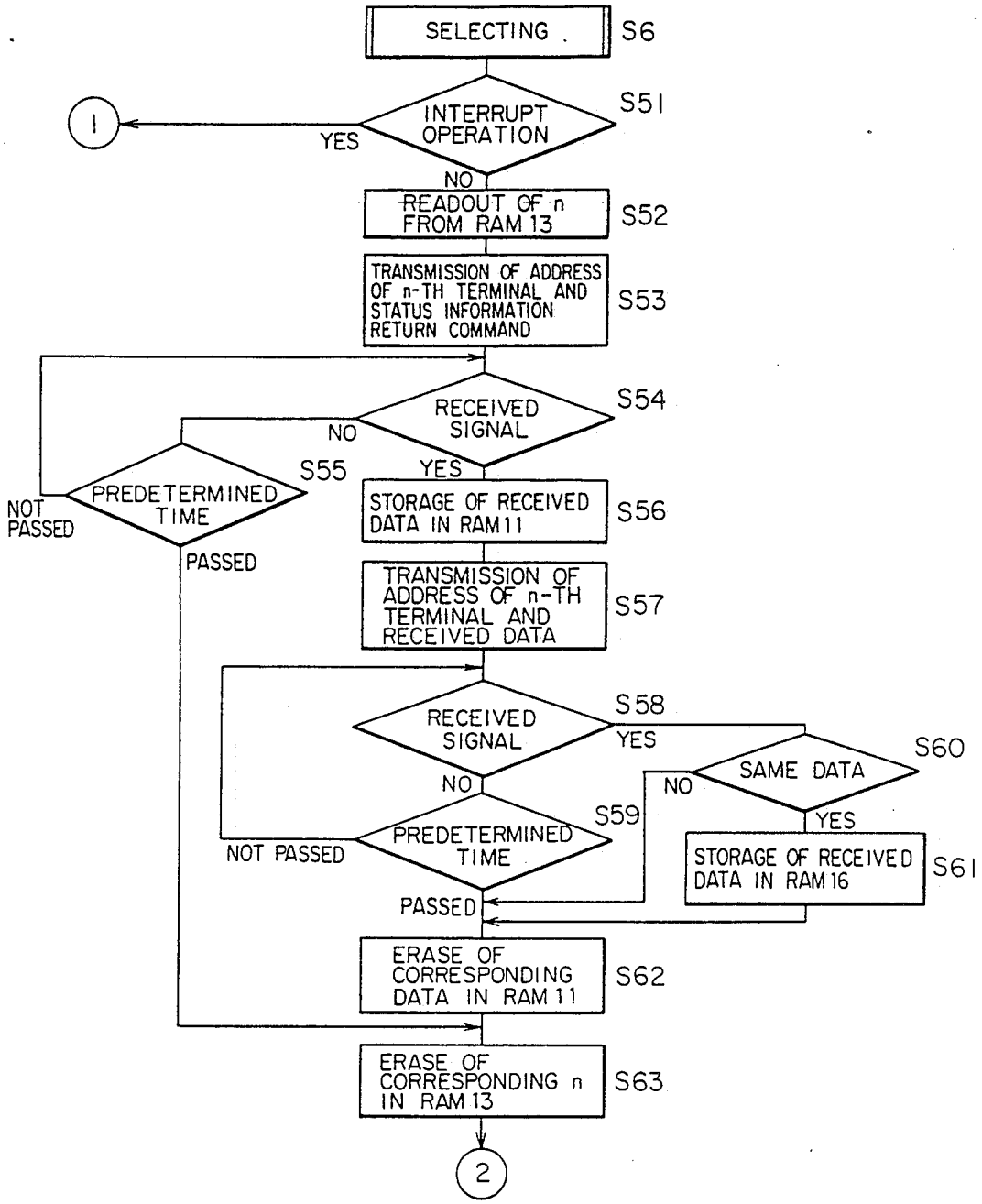
FIGS. 8(1) and 8(2) are flowcharts showing an example of the a concrete example of selecting (S6) in the above embodiment.
Figure 8:
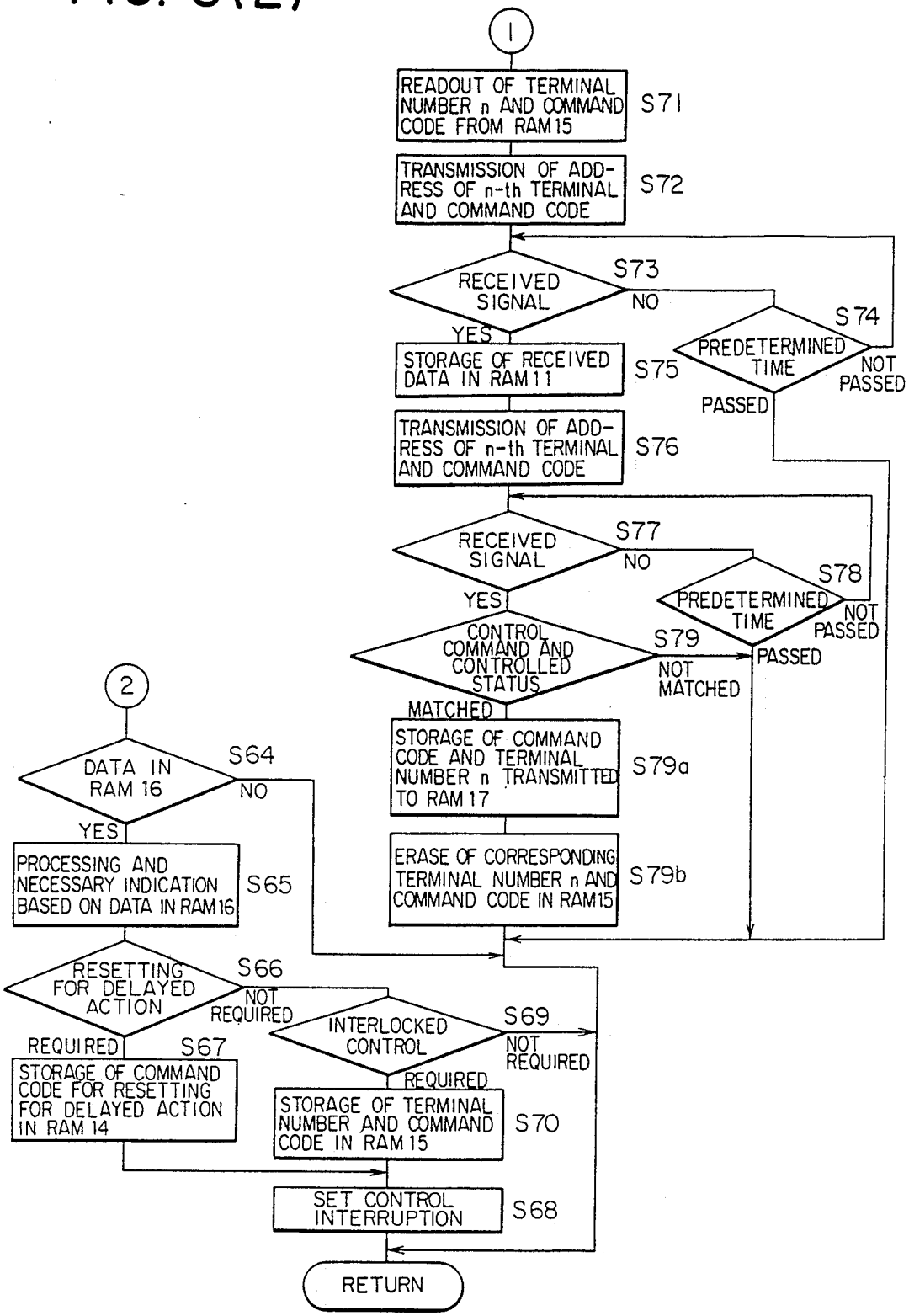

FIGS. 8(1) and 8(2) are flowcharts which shows a specific example of the selecting (S6) in the above embodiment.

In the supervisory mode (S51) of the operation, the terminal number n is read out from the RAM13, and the address of the terminal number n and the first status information command CM1 are transmitted to the terminals (S52, S53), then a predetermined length of time is provided to await a signal indicating the received information (address and data from the repeater terminal hereinafter called 'received signal')(S54, S55). If the signal is received (S54), the received data is stored in the RAM11 to be compared with secondarily received data, and the address of the terminal number n and the received data DA are transmitted to the terminal number n (S56, S57). Then, a predetermined length of time is provided to await the 'received signal' (S58, S59). If the signal is received and the first received data and the secondarily received data are the same, the received data are stored in the RAM16 (S60, S61). At this time the data in the RAM11 and the terminal number n in the RAM13 are erased (S62, S63), and data in the RAM16, if having been stored, are processed and necessary indications are given (S64, S65), i.e. indications of fire and/or status information are given on the basis of the data stored in the RAM16.

From the results of processing of the received data in the RAM16, a judgment is made as to whether the delayed action is required for confirmation of a fire (S66). If it is required, the resetting command code for the delayed action is stored in the RAM14 to prepare for start of delayed action, and control interruption is set (S67, S68), then the operation returns to the main program. If the resetting for delayed action is not required, but the interlocked control is required at S66, the terminal number and the command code are stored in the RAM15 and the control interruption is set, referring to the interlocked control table ROM13. (S69, S70, S68).

On the other hand, in the case of an interruption operation (in the control mode) at the selecting operation (S6), the terminal number n and the command code are read out from the RAM15, and the address of the terminal number n and the command code CM3 are transmitted for the first time (S71, S72). And, a predetermined length of time is provided to await a 'received signal' (address and data from the repeater). If the signal is received (S73, S74), the received data DA are stored in the RAM11, and the address of the terminal number n and the command code CM3 are retransmitted for the second time (S75, S76).

Then, a predetermined length of time is provided to await and receive a 'received signal' (S77, S78). When the control command and the secondarily received information on the control status of the terminal match (S79), the command code and the terminal number n already transmitted are stored in the RAM17 to later judge whether or not the command sent and the resultant control match, and the terminal number n and code are erased from the RAM15 to prevent them from being retransmitted (S79*a*, S79*b*).

Figure 9:
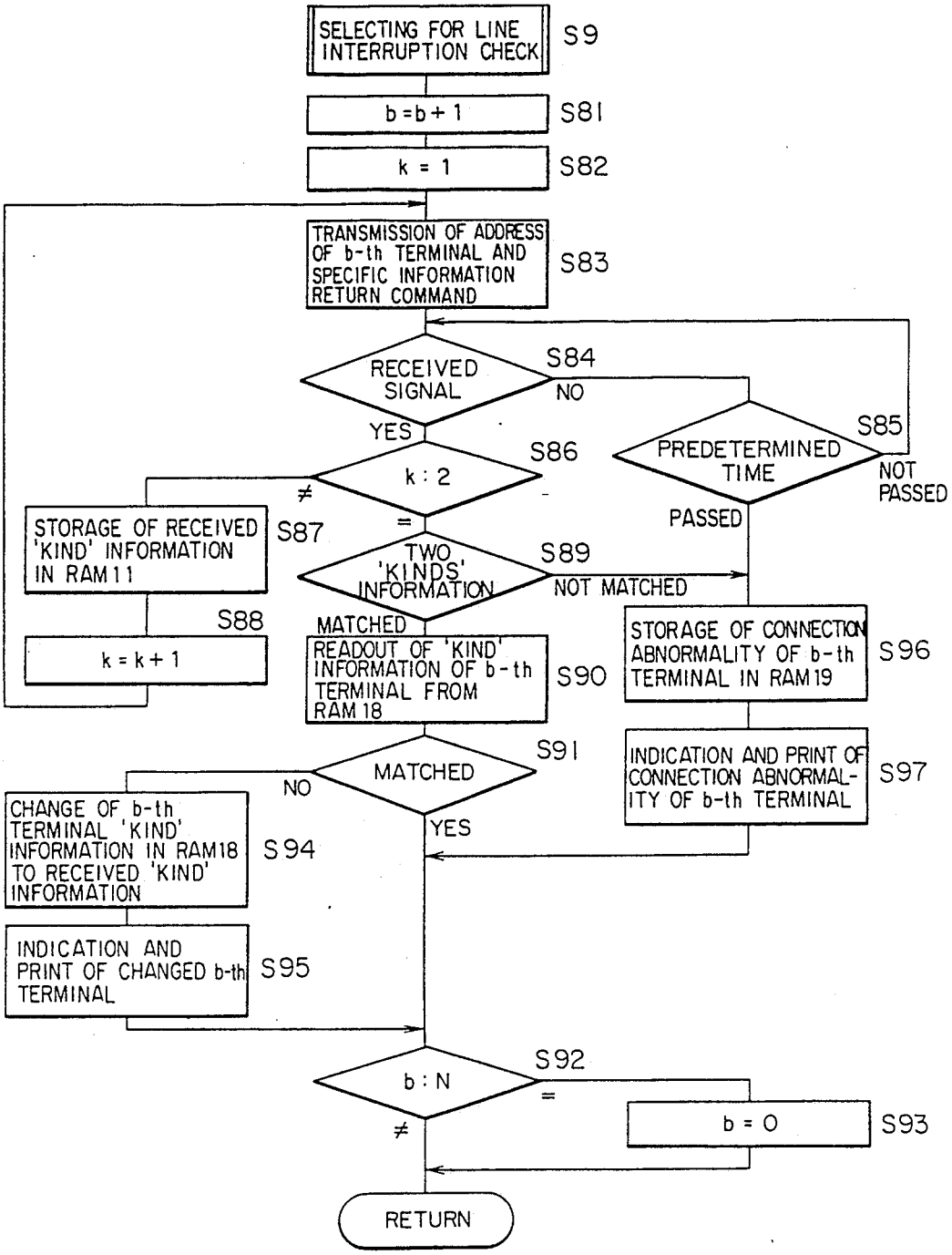
FIG. 9 is a flowchart showing an example of the selecting (S9) for line interruption supervision in the above embodiment.

FIG. 9 is a flowchart showing the operation of line interruption supervision in the above embodiment.

Firstly, the address b of the repeater which performs line interruption supervision is incremented by one, and the transmission frequency k is set to [1](S81, S82). Although the transmission frequency k is set to two in the above embodiment, it may be set to more than three in order to confirm that the transmission has been made without failure. The frequency of transmission may also be selected to be one.

Then, the address of the terminal number b and the specific information return command CM2 are transmitted (S83), and a predetermined length of time is provided to await a 'received signal' (S84, S85). Since the transmission has been made only once at the time of the receipt of the 'received signal' (S86), the received "type" information CL is stored in the RAM11, and the transmission frequency k is renewed to [2](S81, S88). Then, the operation returns to S83, and the address of the terminal b and the specific information return command CM2 are retransmitted Upon receipt of the 'received signal', the second transmission has been completed (S84-S86), and therefore the first "type" information is compared with the second "type" (S89). When these two "type" information match, the "type" information of the terminal b is read out from the RAM18 (S90). When the information of the terminal b matches the former (S91) the operation returns tO the main program.

If they do not match, it means that the terminal b has been changed to a different type of terminal by mischief or due to construction work. Therefore, the "type" information of the terminal b stored in the RAM18 is changed to the newly received one, and this change is displayed and/or printed (S94, S95). On the other hand, in the event that the first and the second "type" information do not match at S89, the abnormality of the terminal b connection is stored in the RAM19 and displayed and/or printed (S96, S97). If the address b of the repeater for which line interruption supervision is performed matches the last address N in the course of these operations, the address b is set to 0, and the operation returns to the main program.

Figure 10:
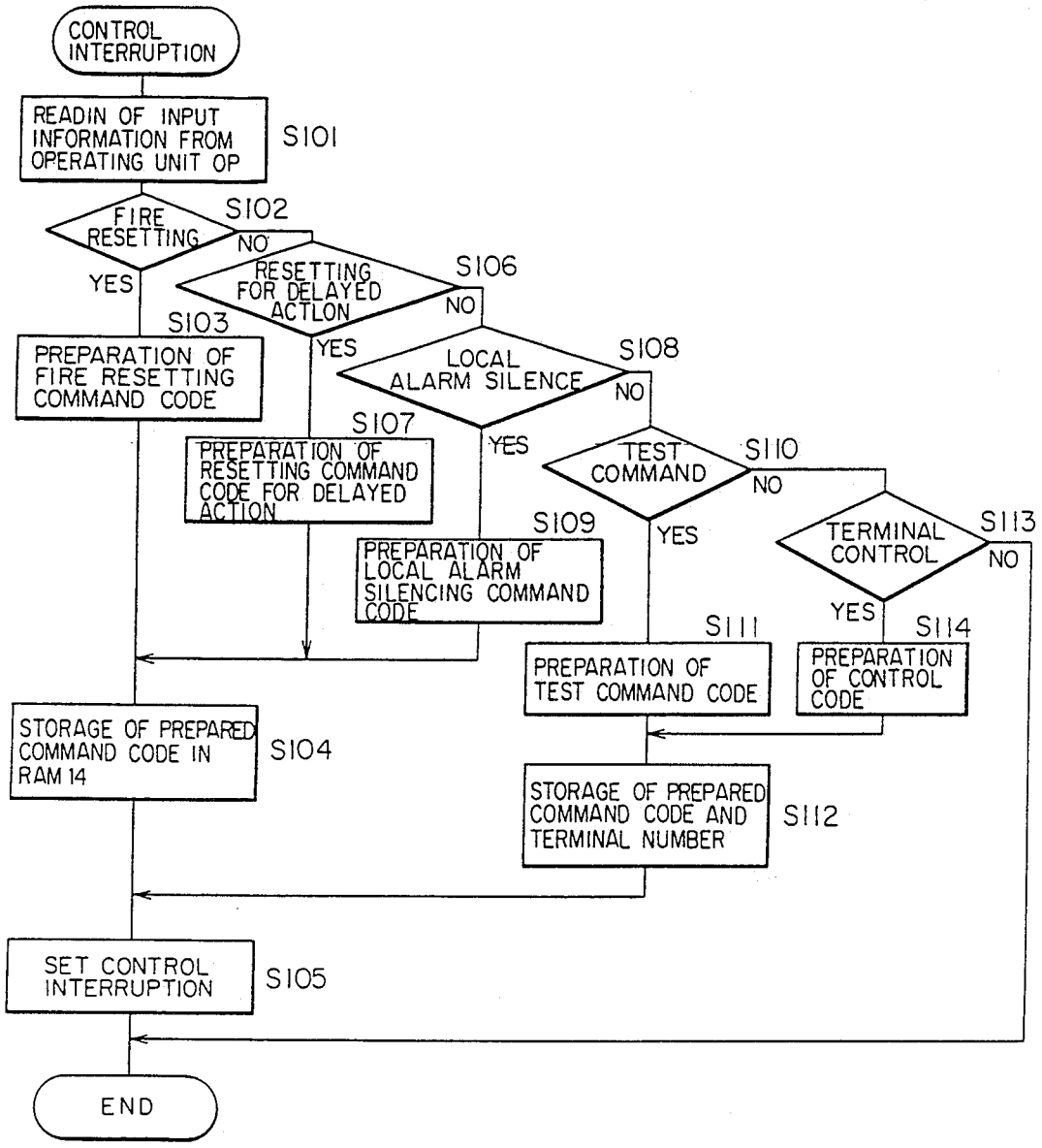
FIG. 10 is a flowchart showing an example of the operation other than that of the flowchart shown in FIG. 5 and operational interruption when the operating unit OP is inputted.

FIG. 10 is a flowchart which shows operations other than that shown in FIG. 3, and a example of the operation interruption when the operating unit OP is input.

Firstly, an input information is read in from the operation unit OP (S101). If the input is a fire resetting command (S102), the fire resetting command code is prepared and stored in the RAM14, and then the control interruption is set by a flag or the like (S103-S105). If the input information is not for fire resetting, but instead a resetting for the start of a delayed action, the resetting command code for start of the delayed action is prepared (S106, S107). If the input is the local alarm silencing command, the corresponding local alarm silencing command code is prepared (S108, S109). If the input is the test command, the test command code is prepared and stored in the RAM15 together with the terminal number n (S110–S112). If the input is the terminal control command, the control code is prepared and stored in the RAM15 together with the terminal number n (S113, S114, S112).

As typical example of the test command at S110, the fire test command may be mentioned, in which case a simulated fire is produced or a gas leak test is conducted. The terminal controls are effected, for example, by ON/OFF control command and include switch-on of the fire door, and switch-on or-off of the smoke vent damper, fire extinguishing device or the like.

Figure 11:
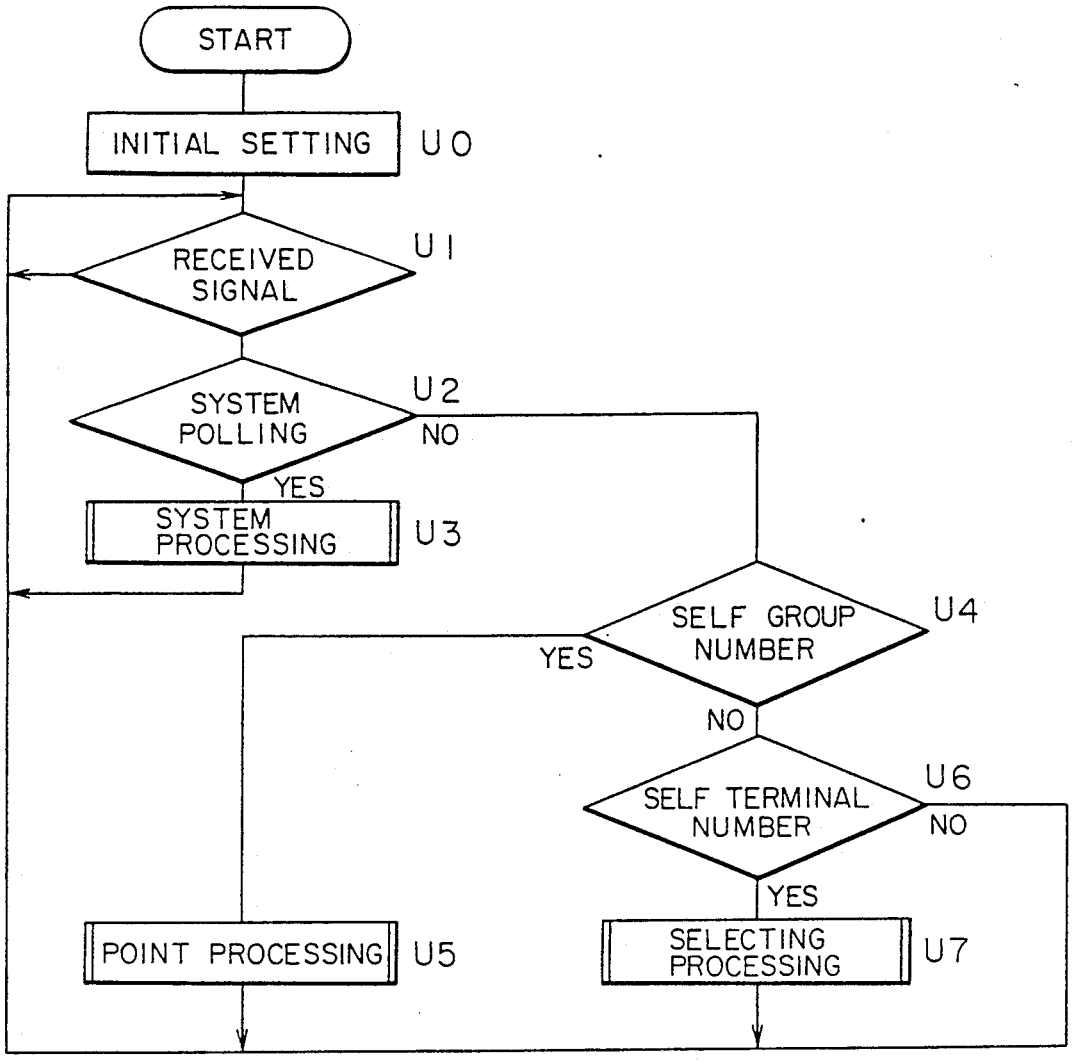
FIG. 11 is an operational flowchart of the repeater in the above embodiment.

FIG. 11 is a main flowchart of the repeater in the above embodiment. The repeater has a terminal number as well as a group number Firstly, the initial setting is performed, and if there is a 'signal' indicating system polling, the system processing is performed (U0–U3). If it is not the system polling signal, the point polling is performed when it has matched the group number in which the repeater is included (U4, U5). If it does not match the group number, but instead matches its own terminal number the selecting processing is performed (U6, U7).

Figure 12:
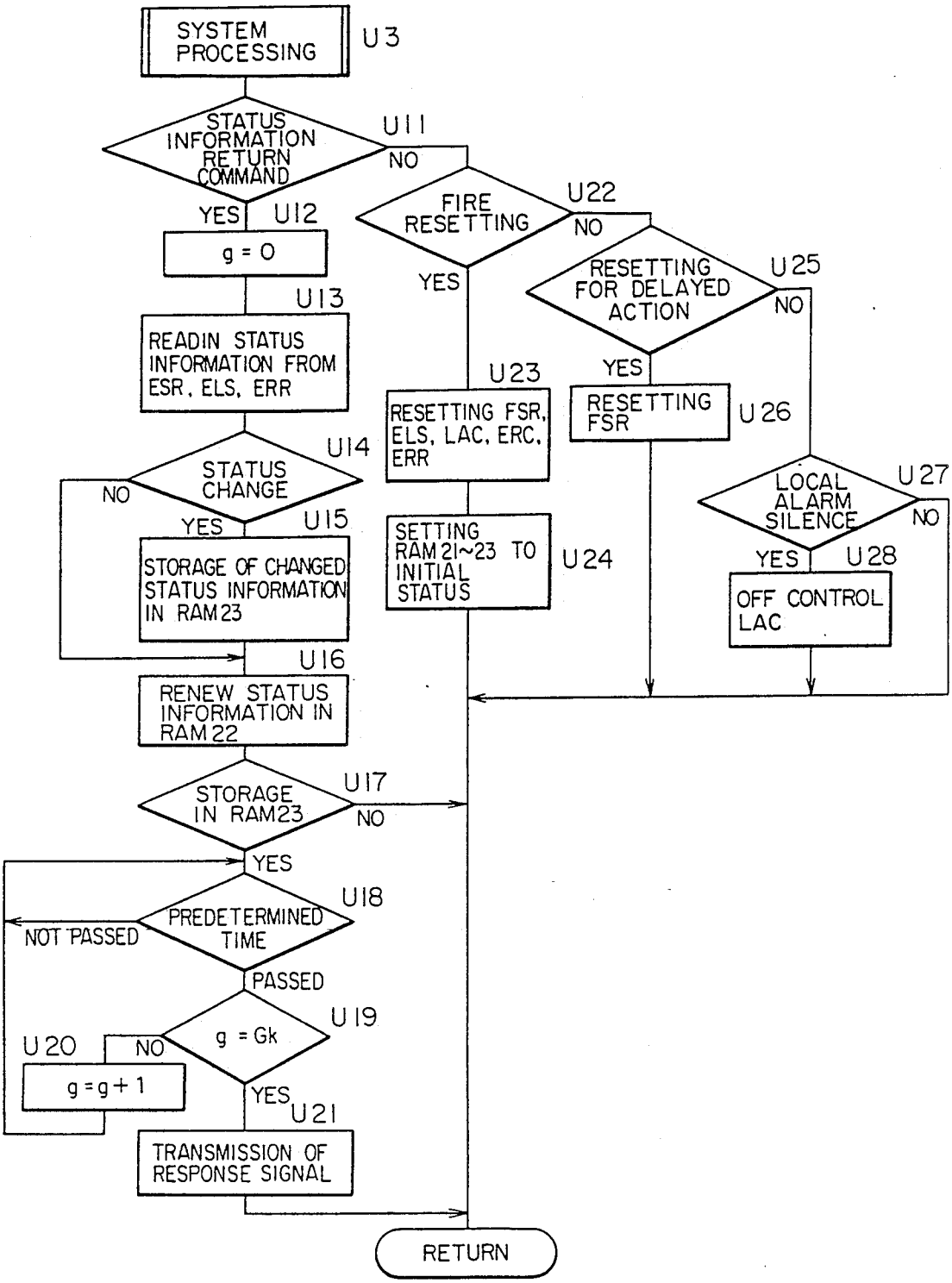
FIG. 12 is a flowchart showing an example of the system processing (U3) shown in FIG. 11.

FIG. 12 is a flowchart showing an example of the system processing (U3) shown in FIG. 11.

Firstly, when the status information return command CM1 is received, the group number g is set to (0), and a status information is read through the fire signal receiving circuit FSR, the zone line interruption supervisory circuit ELS and the terminal response signal receiving circuit ERR (U11–U13). Then, it is compared with the preceding status information stored in the RAM22 to see if there is any status change. If there is a change, the status information with the change is stored in the RAM23 to renew the status information in the RAM22 (U14-U16). And, if there is data stored in the RAM23, a response signal is transmitted when the group number g and its own group number Gk match after lapse of a predetermined time, then the operation returns to the main program (U17–U21). In case the group number g and its own group number Gk do not match, the group number g is incremented by one (U20).

On the other hand, if the command received at the time of system processing is not the status information return command CM1, but is instead the fire resetting command, the FSR, ELS, LAC, ERC and ERR are reset, the RAM21-RAM23 are set to their initial state, and the operation returns to the main program (U22–U24). If it is the resetting command for start of delayed action, the FSR is reset. If it is the local alarm silencing command, the LAC is controlled and silenced (U25–U28).

Figure 13:
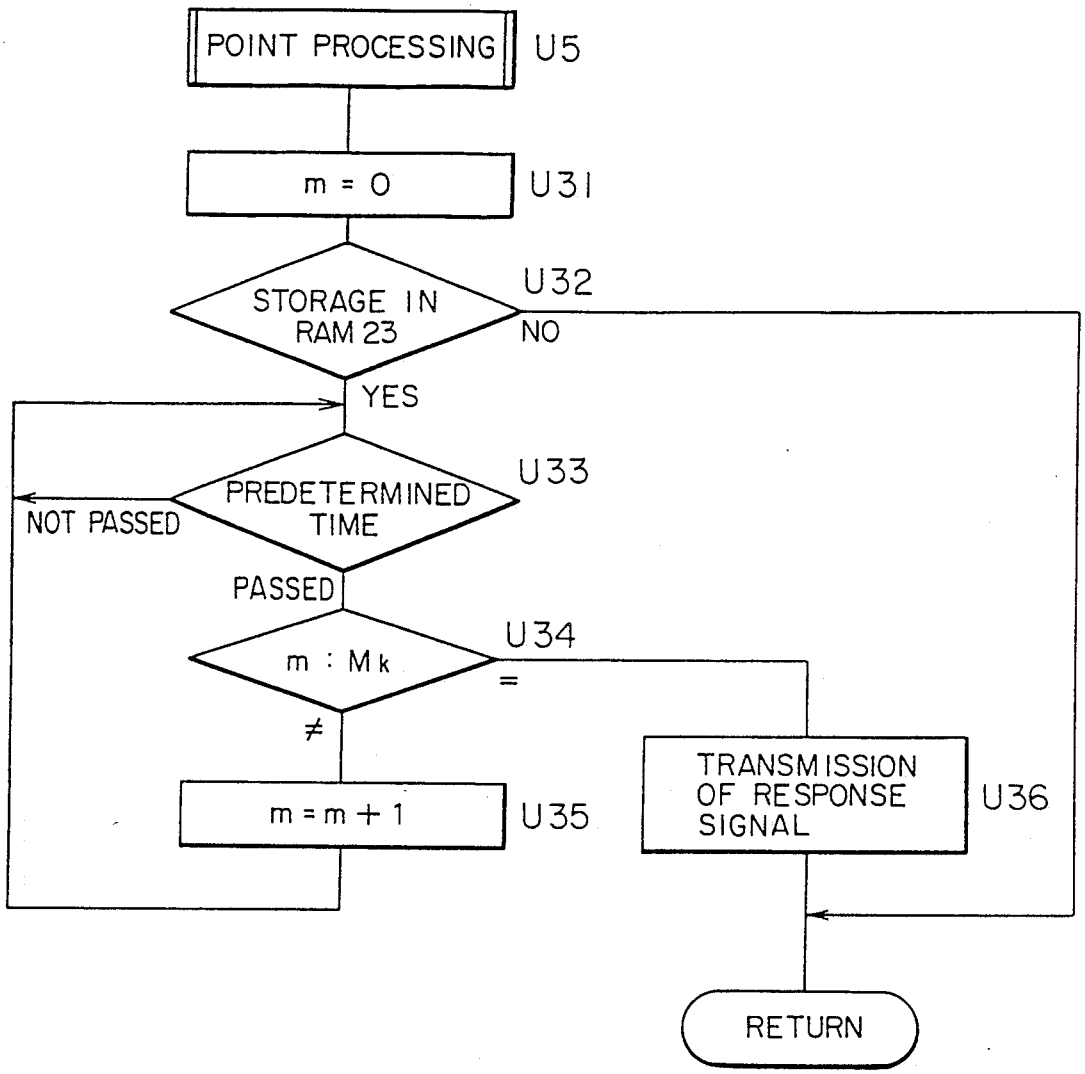
FIG. 13 is a flowchart showing an example of the point processing (U5) shown in FIG. 5.

FIG. 13 is a flowchart showing an example of the point processing (U5) shown in FIG. 11.

When performing the point processing, the terminal number m in the group is set to (0). If there is data stored in the RAM23, the response signal is transmitted when the terminal number m and its own terminal number Mk in the group match after lapse of a predetermined time (U31–U36). In case the terminal numbers m and Mk do not match, the terminal number m is incremented by one (U35).

Figure 14:
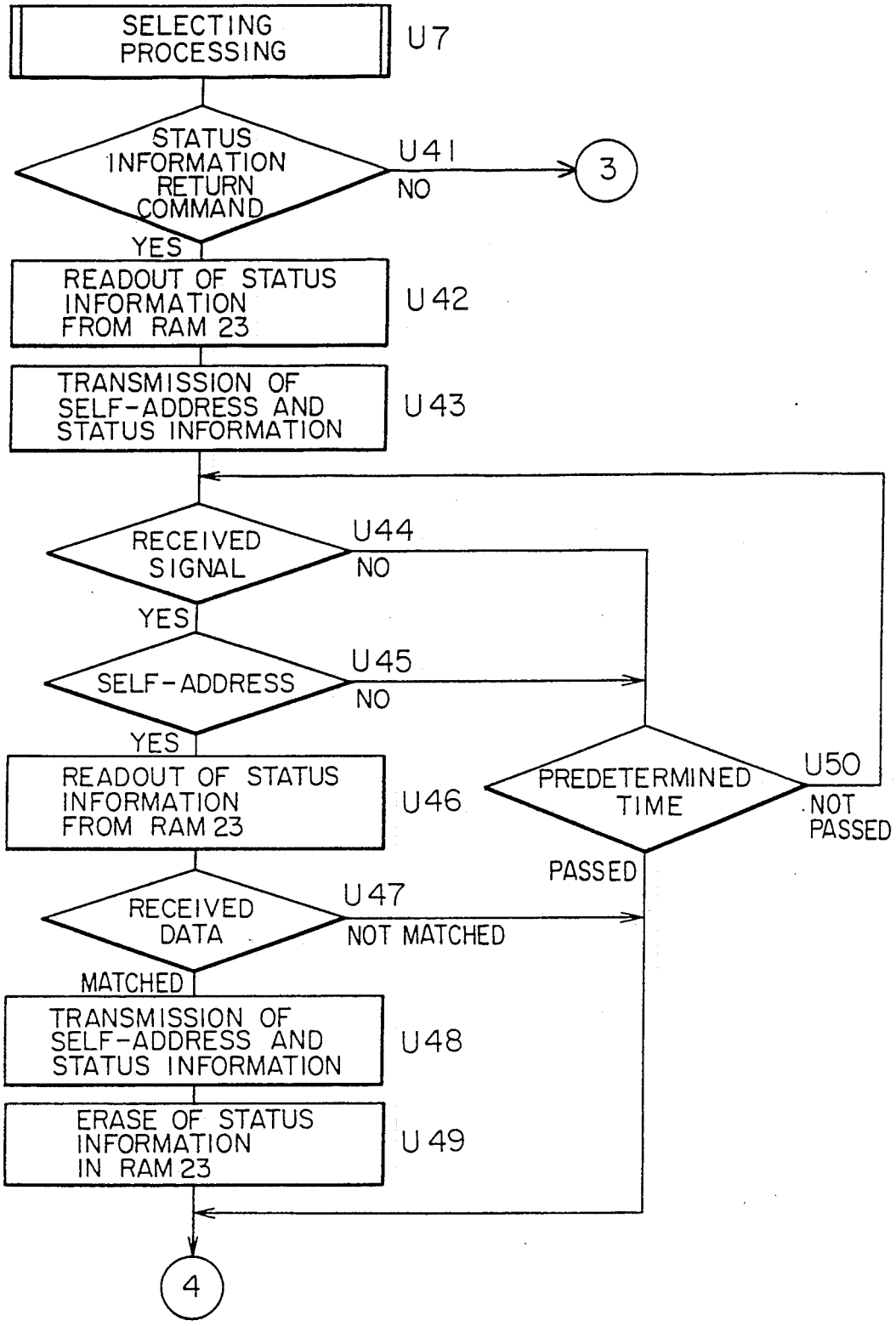
FIGS. 14(1) and 14(2) are a flowchart showing an example of the selecting processing (U7) in FIG. 11.
Figure 14:
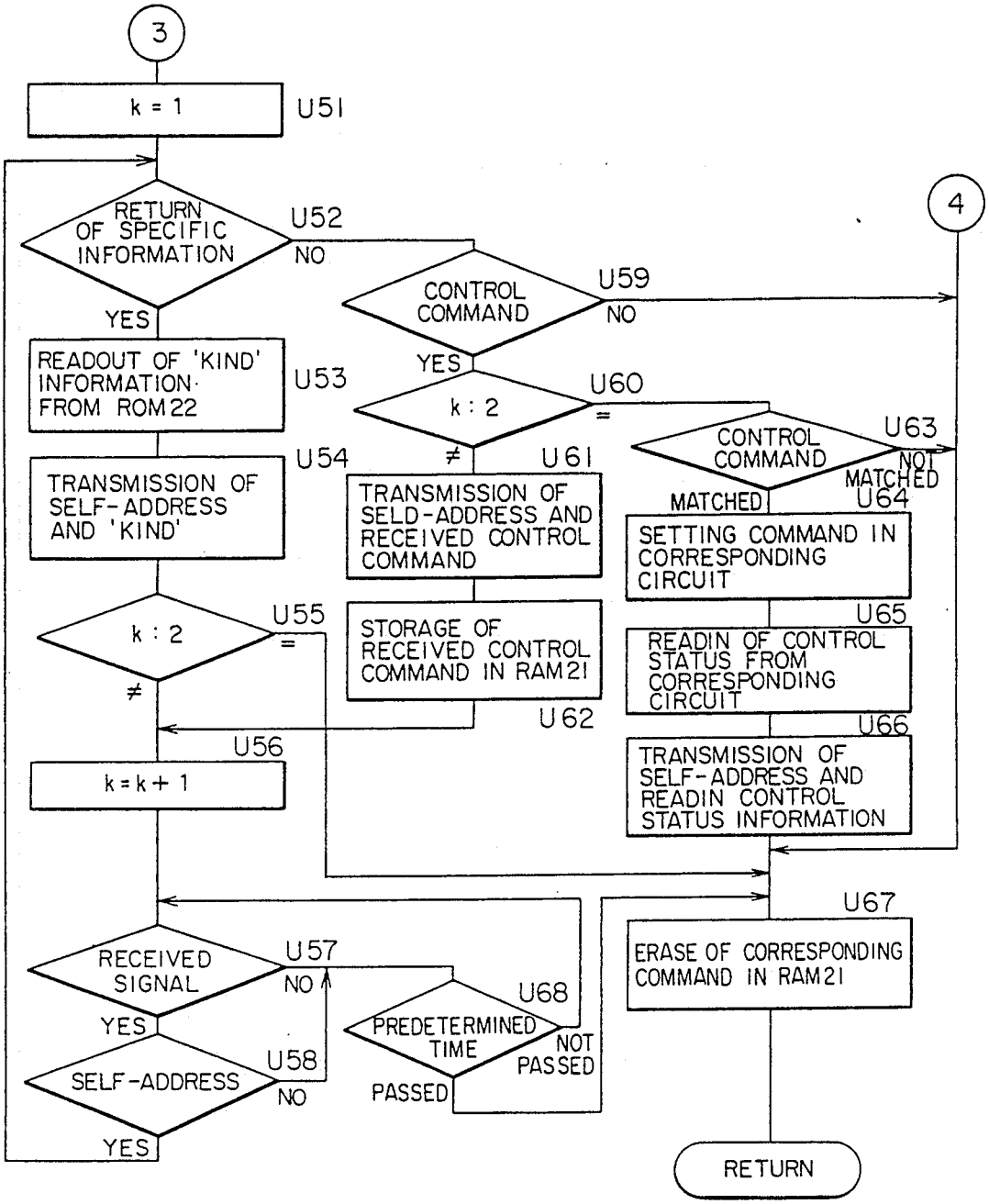

FIG. 14 is a flowchart showing an example of the selecting processing (U7) shown in FIG. 11.

Firstly, if the command specified by selecting is the status information return command CM1, a status information is read from the RAM23, and the self-address and the status information (data DA) are transmitted (U41–U43). If there is a 'received signal' corresponding to the self-address, the status information is read from the RAM23 (U44–U46). If this status information and the received data match, the self-address and the status information are retransmitted, and the status information in the RAM23 is erased for the first time (U47-U49). If there is no 'received signal', or the 'received signal' does not match the self-address, a predetermined time is provided for a standby mode (U50).

After the step U49, the command in the RAM21 is erased, and the operation returns to the main program.

In the event that no status information return command has been received at the step U41, the frequency k of the selecting processing performed is set to 1. When the specific information return command CM2 is received, a "type" information is read from the ROM22, and the self-address and the "type" information CL are transmitted (U51–U54). Then the frequency k of the selecting processing performed is incremented by one, and if the 'received signal' corresponds to the self-address (U56–U58), the operation returns to U52.

On the other hand, when a control command is received instead of the specific information return command at U52 and the selecting processing is performed once, the self-address and the received control command CM3 are transmitted, and then, the received control command is stored in the RAM21 (U59–U62) In the case where the control command is received and the selecting processing is performed twice (U60), the content of the command is set in the circuit when the control commands received during the first and the second selecting match, a control status is read in from the circuit, and the self-address and the read-in control status information (data DA) are transmitted to erase the command in the RAM21 (U63–U67). Then the operation returns to the main program. At U57 a predetermined period of time is provided to await a second signal (U68). If no second signal is received, the command in the RAM21 is erased (U67), and the operation returns to the main program.

In contrast to the above explanation, the point polling and selecting may be performed only once respectively in the above embodiment. When performing the selecting operation in the above embodiment, the predetermined information (the data DA in the case of the above embodiment) which the control panel RE has collected from the terminal which responded during the point polling (terminal T23 in the case of the above embodiment) is returned to the terminal T23. If this returned information is the same as the data DA, the terminal T23 retransmits the data DA to the control panel RE. The control panel RE judges whether or not the retransmitted information is the same as the returned data DA. This means that the ordinary selecting operation is performed twice in the above-mentioned case. By performing the selecting operations twice as described above, it is possible to confirm respectively on the part of the control panel RE and of the terminal that the status information received from the terminal is correct and that the status information sent has properly been received at the control panel RE, thus preventing transmission of such false information as might be caused by induction noise.

In the above case, the control panel collects predetermined information from the terminal which has responded in the course of point polling and returns the collected information to the terminal When the returned information is the same as the predetermined information, the terminal retransmits the predetermined information to the control panel. The control panel is equipped with a selecting capability to judge whether or not the retransmitted information is the same as the returned information.

Also, in the above embodiment, the point polling may be performed twice on the predetermined terminal group. More precisely, the polling is performed twice on each of terminals in the group which responded to the control panel RE at the time of system polling. When the same terminal has consecutively received the response signal twice, this terminal is determined to be the one that transmitted the response signal, and selecting is performed on this particular terminal. So doing, it is possible to prevent transmission of such false information as might be caused by induction noise during the point polling In this case, later the selecting operations may be performed twice as described above. Also, in the above embodiment, the point polling may be performed three or more times on each of the predetermined terminals.

The present invention has an effect to further shorten the time necessary for the receiver unit, such a as the control panel, repeater or the like, to accurately determine the status of all terminals that have shown an abnormality among such terminals, such as a fire detector, repeater and the like, connected to the receiver unit.

What is claimed is:

1. A fire alarm system comprising:

a receiver unit connected to a plurality of terminal unit groupings, each of the terminal unit groupings comprised of a plurality of terminal units, each of the terminal units including at least one of a fire sensor and a remote control means for controlling a remote object;

said receiver unit and said plurality of terminal units including means for operating in a system polling mode wherein all of said plurality of terminal units of said terminal unit groupings are polled, wherein a terminal unit grouping response period is provided for each of said terminal unit groupings, and wherein a group response signal is transmitted from a terminal unit having a change of status to said receiver unit during the terminal unit grouping response period of the terminal unit grouping which includes the terminal unit having a change of status;

said receiver unit and said plurality of terminal units further comprising means for operating in a point polling mode wherein all of the terminal units of the terminal unit grouping from which the group response signal was transmitted during the system polling mode are polled, wherein a terminal unit response period is provided for each of the terminal units of said terminal unit grouping from which the group response signal was transmitted group the system polling mode, and wherein a terminal unit response signal is transmitted from the terminal unit having a change of status to the receiver unit during the terminal unit response period of the terminal unit having a change of status;

said receiver unit and said plurality of terminal units further comprising means for operating in a selecting mode wherein status information is transmitted to said receiver unit from said terminal unit from which the terminal unit response signal was transmitted during the point polling mode.

2. A fire alarm system comprising:

a receiver unit connected to a plurality of terminal unit groupings, each of the terminal unit groupings comprised of a plurality of terminal units, each of the terminal units including at least one of a fire sensor and a remote control means for controlling a remote object;

said receiver unit and said plurality of terminal units including means for operating in a system polling mode wherein all of said plurality of terminal units of said terminal unit groupings are polled, wherein a terminal unit grouping response period is provided for each of said terminal unit groupings, and wherein a group response signal is transmitted from a terminal unit having a change of status to said receiver unit during the terminal unit grouping response period of the terminal unit grouping which includes the terminal unit having a change of status;

said receiver unit and said plurality of terminal units further comprising means for operating in a point polling mode wherein all of the terminal units of the terminal unit grouping from which the group response signal was transmitted during the system polling mode are polled, wherein a terminal unit response period is provided for each of the terminal units of said terminal unit grouping from which the group response signal was transmitted during the system polling mode, and wherein a terminal unit response signal is transmitted from the terminal unit having a change of status to the receiver unit during the terminal unit response period of the terminal unit having a change of status;

said receiver unit and said plurality of terminal units further comprising means for operating in a selecting mode wherein control command signals for controlling a remote object are transmitted from said receiver unit to said remote control means of one of said terminal units in response to the terminal response signal transmitted during the point polling mode.

3. A fire alarm system comprising:

a receiver unit connected to a plurality of terminal unit groupings, each of the terminal unit groupings comprised of a plurality of terminal units, each of the terminal units including at lest one of a fire sensor and a remote control means for controlling a remote object;

said receiver unit and said plurality of terminal units including means for operating in a system polling mode wherein all of said plurality of terminal units of said terminal unit groupings are polled, wherein a terminal unit grouping response period is provided for each of said terminal unit groupings, and wherein a group response signal is transmitted from a terminal unit having a change of status to said receiver unit during the terminal unit grouping response period of the terminal unit grouping which includes the terminal unit having a change of status;

said receiver unit and said plurality of terminal units further comprising means for operating in a point oplling mode wherein all of the terminal units of the terminal unit grouping from which the group response signal was transmitted during the system poling mode are polled, wherein a terminal unit response period is provided for each of the terminal units of said terminal unit grouping from which the group response signal was transmitted during the system polling mode, and wherein a terminal unit response signal is transmitted from the terminal unit having a change of status to the receiver unit during the terminal unit response period of the terminal unit having a change of status;

said receiver unit and said plurality of terminal units further comprising means for operating in a selecting mode wherein status information is transmitted to said receiver unit from said terminal unit from which the terminal unit response signal was transmitted during the point polling mode, and wherein control command signals for controlling a remote object are transmitted from said receiver unit to said remote control means of one of said terminal units in response to the terminal response signal transmitted during the point polling mode.

4. A fire alarm system as recited in any one of claims 1, 2 or 3, said receiver unit comprising means for transmitting a common command signal to each of said terminal units during said system polling mode.

5. A fire alarm system as recited in any one of claims 1, 2 or 3, said receiver nit and said terminal units further comprising means for repeatedly polling a predetermined number of times, in the point polling mode, all of said terminal units of said terminal unit grouping from which the group response signal was transmitted during the system polling mode after each transmission of the terminal unit response signal, to thereby verify an identity of said terminal unit having a change of status.

6. A fire alarm system as recited in any one of claims 1, 2 or 3, said receiver unit and said terminal units further comprising line interruption supervisory means for operating in the selecting mode to determine whether an open circuit is present between said receiver unit and at least one terminal unit and to transmit specific information from each of said terminal units to said receiver unit.

7. A fire alarm system as recited in claim 6, said line interruption supervisory means including means for causing said receiver unit to successively request the specific information from at lest one of said terminal units subsequent to each time the system polling mode is carried in which an absence of a group response signal is detected.

8. A fire alarm system as recited in claim 6, wherein the specific information denotes a type of terminal unit, and said line interruption supervisory means includes means for comparing a prestored information of the type of terminal unit and the type of terminal unit denoted by the specific information.

9. A fire alarm system as recited in any one of claims 1, 2 or 3, said receiver unit and said plurality of terminal units including means for repeatedly operating in the selecting mode to verify at least one of the status information and the control of a remote object.

10. A fire alarm system as recited in any one of claims 1, 2 or 3, said receiver unit and said plurality of terminal units further including means for operating in the selecting mode to cause the receiver unit to return the status information from said receiver unit to said terminal unit from which the status information was transmitted, to cause said terminal unit to compare the transmitted and received status information and upon a coincidence to again transmit the status information to said receiver unit, and to cause said receiver unit to compare the thus received status information with the previously received status information.

11. A fire alarm system as recited in claim 4, wherein the common command signal includes at least one of a fire resetting command, a resetting command for a delayed action, and a local alarm silencing command.

12. A fire alarm system as recited in claim 4, said receiver unit and said terminal units further comprising means for repeatedly polling a predetermined number of times, in the point polling mode, all of said terminal units of said terminal unit grouping from which the group response signal was transmitted during the system polling mode after each transmission of the terminal unit response signal, to thereby verify an identity of said terminal unit having a change of status.

13. A fire alarm system as recited in claim 4, said receiver unit and said terminal units further comprising line interruption supervisory means for operating in the selecting mode to determine whether an open circuit is present between said receiver unit and at least one terminal unit and to transmit specific information from each of said terminal units to said receiver unit.

14. A fire alarm system as recited in claim 5, said receiver unit and said terminal units further comprising line interruption supervisory means for operating in the selecting mode to determine whether an open circuit is present between said receiver unit and at least one terminal unit and to transmit specific information from each of said terminal units to said receiver unit.

15. A fire alarm system as recited in claim 7, wherein the specific information denotes a type of terminal unit, and said line interruption supervisory means includes means for comparing a prestored information of the type of terminal unit and the type of terminal unit denoted by the specific information.

16. A fire alarm system as recited in claim 4, said receiver unit and said plurality of terminal units including means for repeatedly operating in the selecting mode to verify at least one of the status information and the control of a remote object.

17. A fire alarm system as recited in claim 5, said receiver unit and said plurality of terminal units including means for repeatedly operating in the selecting mode to verify at least one of the status information and the control of a remote object.

18. A fire alarm system as recited in claim 6, said receiver unit and said plurality of terminal units including means for repeatedly operating in the selecting mode to verify at least one of the status information and the control of a remote object.

19. A fire alarm system as recited in claim 4, said receiver unit and said plurality of terminal units further including means for operating in the selecting mode to cause the receiver unit to return the status information from said receiver unit to said terminal unit from which the status information was transmitted, to cause said terminal unit to compare the transmitted and received status information and upon a coincidence to again transmit the status information to said receiver unit, and to cause said receiver unit to compare the thus received status information with the previously received status information.

20. A fire alarm system as recited in claim 5, said receiver unit and said plurality of terminal units further including means for operating in the selecting mode to cause the receiver unit to return the status information from said receiver unit to said terminal unit from which the status information was transmitted, to cause said terminal unit to compare the transmitted and received status information and upon a coincidence to again transmit the status information to said receiver unit, and to cause said receiver unit to compare the thus received status information with the previously received status information.

21. A fire alarm system as recited in claim 6, said receiver unit and said plurality of terminal units further including means for operating in the selecting mode to cause the receiver unit to return the status information from said receiver unit to said terminal unit from which the status information was transmitted, to cause said terminal unit to compare the transmitted and received status information and upon a coincidence to again transmit the status information to said receiver unit, and to cause said receiver unit to compare the thus received status information with the previously received status information.

* * * * *